US008718307B2

(12) United States Patent
Schumaier et al.

(10) Patent No.: US 8,718,307 B2
(45) Date of Patent: May 6, 2014

(54) HEARING AID APPARATUS

(75) Inventors: Daniel R. Schumaier, Elizabethton, TN (US); David M. Campbell, II, Johnson City, TN (US)

(73) Assignee: Daniel R. Schuamier, Elizabethton, TN (US)

( * ) Notice: Subject to any disclaimer, the term of this patent is extended or adjusted under 35 U.S.C. 154(b) by 391 days.

(21) Appl. No.: 13/046,114

(22) Filed: Mar. 11, 2011

(65) Prior Publication Data

US 2012/0230529 A1 Sep. 13, 2012

(51) Int. Cl.
*H04R 25/00* (2006.01)

(52) U.S. Cl.
USPC ..... 381/326; 381/322; 381/324; 381/312; 381/151; 381/328; 381/161; 381/162; 600/25

(58) Field of Classification Search
USPC ..... 381/322, 324, 312, 326, 151, 328, 161, 381/162; 600/25
See application file for complete search history.

(56) References Cited

U.S. PATENT DOCUMENTS

| | | | | |
|---|---|---|---|---|
| 4,150,262 | A * | 4/1979 | Ono | 381/326 |
| 5,673,328 | A * | 9/1997 | Wandl et al. | 381/151 |
| 6,643,378 | B2 | 11/2003 | Schumaier | |
| 7,302,071 | B2 | 11/2007 | Schumaier | |
| 2002/0122563 | A1 * | 9/2002 | Schumaier | 381/326 |
| 2004/0240694 | A1 * | 12/2004 | Wolf | 381/322 |
| 2010/0067725 | A1 | 3/2010 | Schumaier et al. | |
| 2010/0069705 | A1 | 3/2010 | Schumaier | |
| 2010/0211142 | A1 * | 8/2010 | Rogers et al. | 607/113 |

* cited by examiner

*Primary Examiner* — Curtis Kuntz
*Assistant Examiner* — Thomas Maung
(74) *Attorney, Agent, or Firm* — Luedeka Neely Group, P.C.

(57) ABSTRACT

A bone conduction hearing aid includes an in-the-ear (ITE) component including a transducer that is carried by the ITE component and positioned in the concha of the ear when in use. A vibrationally conductive structural member of the ITE component conducts vibration produced the transducer into the ear canal and such vibrations are transferred through a housing of the transducer. From there, the vibrations are transferred to a cochlea of the user by way of the mastoid bone, enabling enhanced hearing perception in patients with hearing loss.

11 Claims, 8 Drawing Sheets

HEARING AID APPARATUS

FIELD

This disclosure relates generally to hearing aids. More particularly, the present invention relates to a bone conduction hearing assistance device having a transducer which is placed in the concha of the ear.

BACKGROUND

For many hearing loss patients, bone conduction hearing aids offer a better solution than more conventional acoustic/air transmitting hearing aids. Indeed, for some patients bone conduction hearing aids offer the only solution. Bone conduction hearing assistance generally involves vibration of the patient's mastoid bone to improve hearing perception. In a typical bone conduction hearing aid, sound sensed by a microphone is converted to an electrical signal and amplified. The amplified signal is then received by a small transducer which vibrates the mastoid bone. Strategic placement of the transducer on the user is essential in order to achieve optimal results. For example, with some bone conduction hearing aids the transducer is placed against the skin behind the ear, while with others the transducer is placed on the forehead. Still others require surgical implantation of the transducer directly into the mastoid bone for better transmission of vibration. However, all of these approaches have significant disadvantages.

One particularly effective approach has been to mount the transducer on an in-the-ear ("ITE") structural member. The structural member is inserted in the patient's ear canal so that the transducer is positioned adjacent the mastoid bone. While this approach has been shown to provide excellent vibration transfer characteristics, it is unavailable for patients with ear canals too small to receive the transducer, such as patients who suffer from congenital atresia—a condition where the ear canal is narrowed or, in some cases, entirely closed off from the ear drum.

In any case, space for accommodating parts within an earpiece shell of a hearing aid is very limited, particularly within ITE hearing aids. Thus, the efficient use of space within a structural member is a highly significant and limiting factor.

What is needed, therefore, is technology to increase the space for working components. What is also needed is technology to allow smaller earpiece shells of ITE hearing aids to be manufactured for persons with smaller ears and associated ear structures.

SUMMARY

The above and other needs are met by an apparatus for imparting vibrational energy to a user for assistance in hearing. The apparatus includes an earpiece shell having a cavity that defines an inner surface of the earpiece shell, and a transducer disposed at least partially within the earpiece shell. The transducer includes a housing engaged adjacent the inner surface of the earpiece shell, a spring member attached adjacent the housing, and a weight having a mass. The weight is attached adjacent the spring member and is movable within the cavity without contacting the earpiece shell. The transducer also includes means for initiating vibration disposed at least partially within the housing. The means for initiating vibration imparts vibrational energy to the weight to cause the weight to vibrate at a frequency which is dependent at least in part upon the mass of the weight attached adjacent the spring member. The earpiece shell conducts this vibrational energy to the user. Preferably, the housing of the transducer is press fit into the cavity of the earpiece shell. Preferably, the earpiece shell further includes an interference structure which controls a depth of insertion of the housing into the earpiece shell when the housing is press fit into the cavity. Preferably, the earpiece shell is formed from one or more acrylate polymers. In some embodiments, the means for initiating vibration further comprises a piezoelectric crystal. In other embodiments, the means for initiating vibration comprises a coil and a magnet.

In a related embodiment, the earpiece shell has a cavity that defines an inner surface of the earpiece shell. The cavity is configured for receiving the transducer housing in a press fit engagement. However, this embodiment includes only the earpiece shell itself without the internal parts with which it is configured for engagement.

In another related embodiment, the earpiece shell includes an aperture for receiving the housing of the transducer into the cavity and a cover plate configured for substantially covering the aperture. In these and other embodiments, the peak frequency of the vibrational energy ranges from about 500 Hz to about 3000 Hz when the mass is varied over a ratio of about 36:1. In these and other embodiments, the resonant frequency of the vibrational energy is preferably proportional to the inverse of the square root of the mass.

In some embodiments, the inner surface of the earpiece shell further includes at least two substantially flat inner sub-surfaces including a first inner sub-surface and a second inner sub-surface, wherein the housing of the transducer includes an outer surface including at least one substantially flat outer sub-surface with a first outer sub-surface, and wherein the first inner sub-surface fits tightly against the first outer sub-surface.

In some embodiments, the inner surface of the earpiece shell further includes at least two substantially flat inner sub-surfaces including a first inner sub-surface and a second inner sub-surface. The housing of the transducer further includes an outer surface having at least one substantially flat outer sub-surface with a first outer sub-surface, wherein the first inner sub-surface is attached to the first outer sub-surface.

In another aspect, embodiments of the disclosure provide a method of altering the output frequency of an apparatus that imparts vibrational energy to a user for assistance in hearing. The apparatus includes an earpiece shell for conducting the vibrational energy to the user and a transducer disposed at least partially within the earpiece shell. The earpiece shell includes a cavity that defines an inner surface of the earpiece shell, and the transducer includes a first housing engaged adjacent the inner surface of the earpiece shell. The transducer also includes a first spring member attached adjacent the housing and a first weight having a first mass. The first weight is attached adjacent the first spring member and is movable within the cavity without contacting the earpiece shell. First means for initiating vibration are disposed at least partially within the first housing. The first means for initiating vibration imparts vibrational energy to the first weight to cause the first weight to vibrate at a frequency which is dependent at least in part upon the mass of the first weight attached adjacent the first spring member. The method includes the steps of (a) removing a first set of one or more components from the earpiece, wherein the first set of one or more components includes at least the first weight; and (b) adding a second set of one or more components to the earpiece to replace the first set of one or more components removed in step (a), wherein the second set of one or more components includes at least a second weight having a second mass, wherein the second mass is not equal to the first mass.

In a related embodiment, step (a) further includes removing one or more of the first housing, the first means for initiating vibration, and the first spring member; and step (b) further comprises adding one or more of a second housing, a second means for initiating vibration, and a second spring member to replace the one or more components removed in step (a).

In another aspect, embodiments of the disclosure provide a transducer for use within an earpiece shell. The transducer includes a housing configured for attachment adjacent an inner surface of an earpiece shell, a spring member attached adjacent the housing, a weight having a mass, and means for initiating vibration disposed at least partially within the housing. The means for initiating vibration imparts vibrational energy to the weight to cause the weight to vibrate at a frequency which is dependent at least in part upon the mass of the weight attached adjacent the spring member. A power source provides power to the means for initiating vibration. The transducer is configured so that the weight freely vibrates, based at least in part on the energy transmitted through the spring member, without coming into direct contact with any other solid object during operation.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
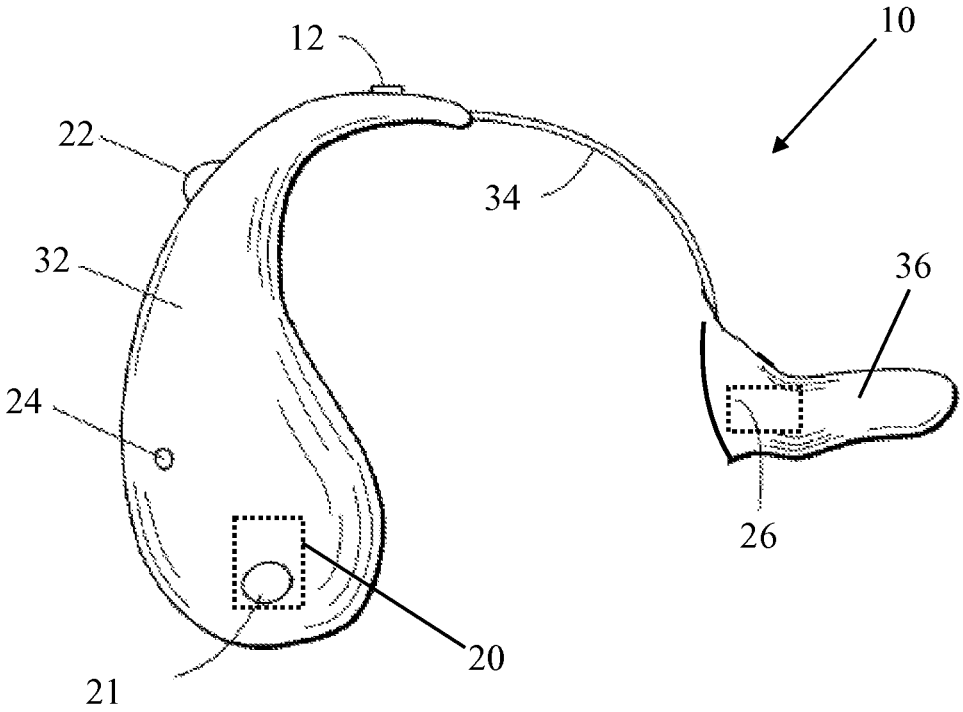
FIG. 1 shows a somewhat schematic view of a hearing aid apparatus including an in the ear (ITE) component and a behind the ear (BTE) component.
Figure 2:
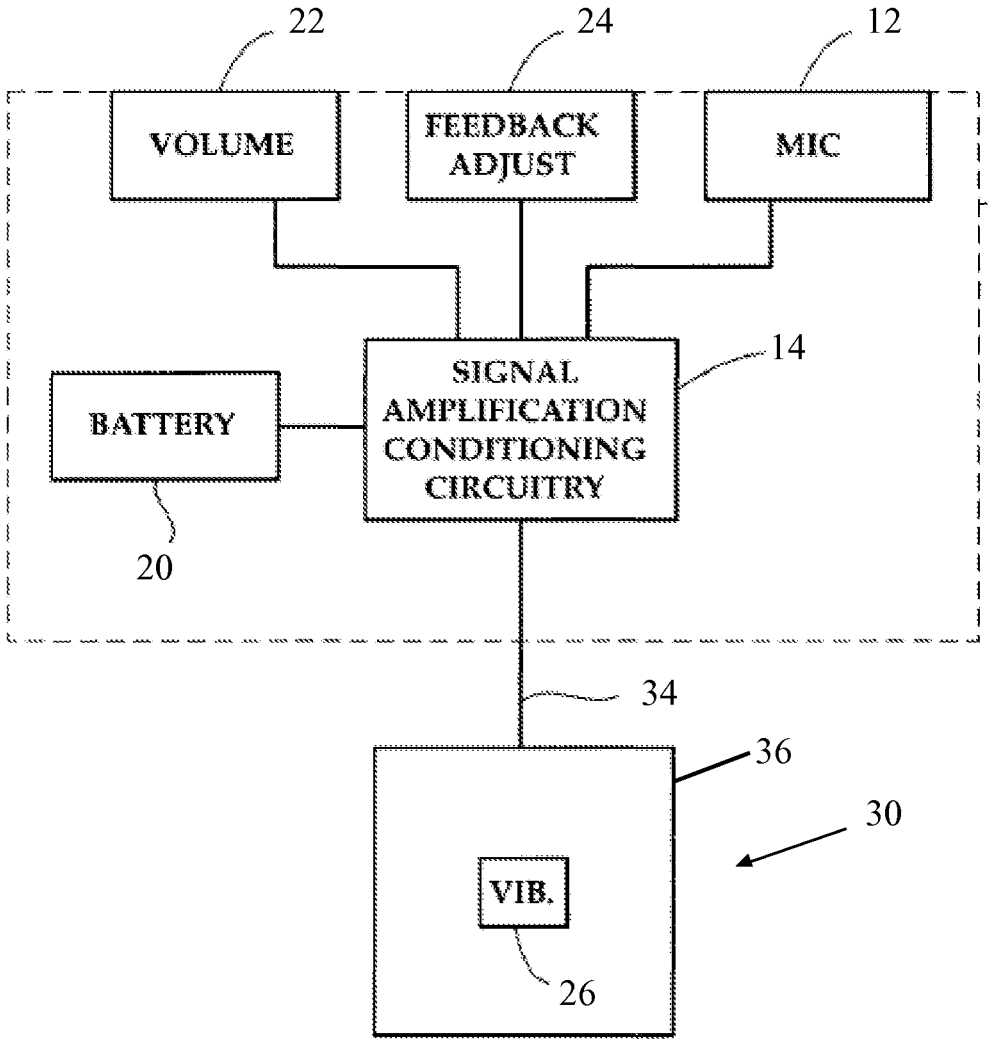
FIG. 2 shows a functional block diagram of typical hearing aid having an ITE transducer.

Turning now to the drawings wherein like reference characters indicate like or similar parts throughout, FIGS. 1, 2, and 5-8 illustrate different aspects of a hearing aid apparatus 10. The hearing aid apparatus 10 operates based on the steps of receiving input information in the form of sound waves or other signals (e.g., direct electrical signals) using, for example, a microphone 12, transforming the input information into transfer information (e.g., amplifying, filtering, or otherwise changing the input information) using, for example, an amplifier 14, generating vibrational energy based on the transfer information using, for example, a vibrator or other means for initiating vibration based on an electrical signal 16, and conducting the vibrational energy through an earpiece shell 36 to a user's mastoid bone for interpretation by a user's brain. FIG. 2 shows a functional block diagram illustrating how various parts of a typical ITE bone conduction hearing aid are interconnected in order to carry out these and other steps. Electrical power is provided by a power source 20 which is typically in the form of a battery. An access port 21 is preferably provided to gain access to and replace the power source if necessary. The level of amplification can be adjusted with volume control 22 which controls the gain of the amplifier 14, and an optional feedback control 24 may be provided for adjusting electronic parameters to reduce or eliminate feedback from the vibrator or other means for initiating vibration 16 or from other components. These and other prior art features are discussed, for example, in U.S. Pat. No. 7,302,071 to Schumaier which is incorporated herein by reference in its entirety.

The components that generate vibrations collectively form at least part of what is often referred to as a transducer or vibrator 26 which typically includes, for example, means for initiating vibration 16 and a spring member 18. The transducer 26 also preferably includes a housing 28. The housing 28 is preferably removably fixed within an in the ear (ITE) portion 30 of the hearing aid. Prior art versions of transducers include, for example, the VKH2 produced by BHM-Tech Produktionsgesellschaft mbH of Grafenschachen, Austria, or, for example, a Radio Ear B-71 vibrator or Starkey BC1 vibrator available from Starkey Laboratories, Inc., of Eden Prairie, Minn. Other components such as, for example, the microphone 12 and the amplifier 14 are housed in a behind the ear (BTE) component 32. The ITE component 30 and the BTE component 32 are connected directly by, for example, a conductive wire 34, or, alternatively, by indirect electromagnetic (e.g., infrared or other waveforms) communication technology. The ITE component 30, also referred to as the "earpiece," includes an earpiece shell 36 having a cavity 38 defining an inner surface 40 of the earpiece shell 36. The transducer 26 is preferably located within the cavity 38.

Figure 3:
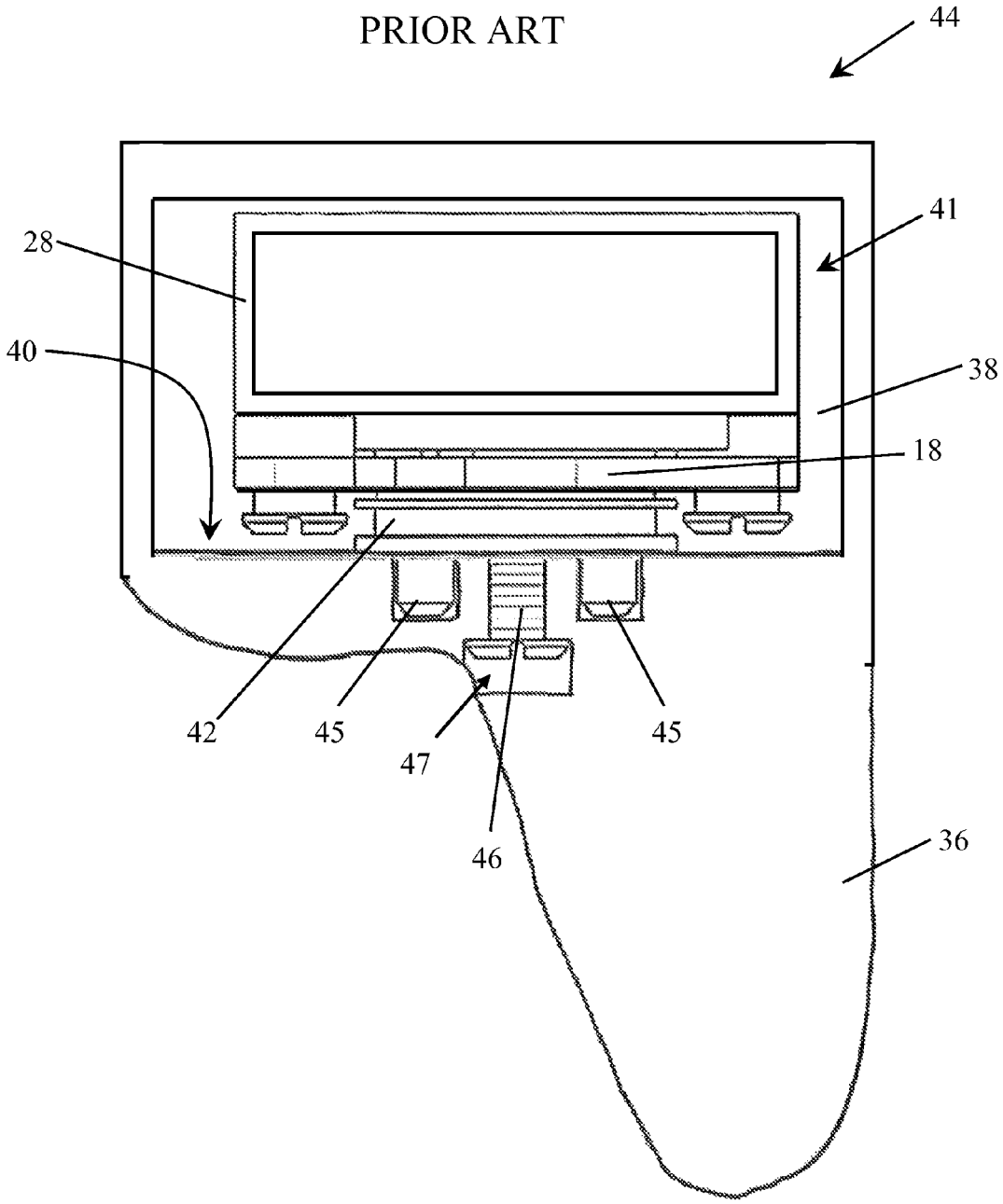
FIG. 3 PRIOR ART
FIG. 3 shows a somewhat schematic cross-sectional view of a prior art version of an ITE hearing aid apparatus.
Figure 4:
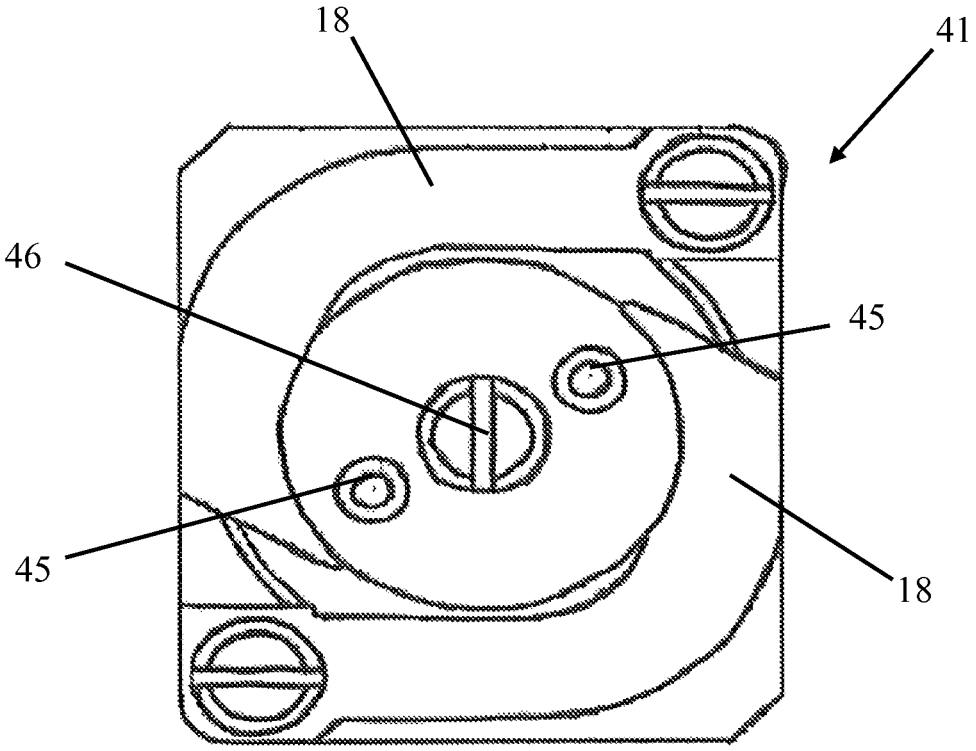
FIG. 4 PRIOR ART
FIG. 4 shows a bottom view of a prior art transducer as depicted in FIG. 3.

In prior art earpieces 44 such as shown in FIGS. 3 and 4, a transducer 41 is attached to the earpiece shell 36 by, for example, a screw 46 which engages a mounting plate 42. One of the drawbacks of the prior art earpiece 44 shown in FIG. 3 is that the mounting plate 42 and associated hardware (e.g., screw 46 and alignment pins 45) take up a significant amount of volume in the cavity 38 of the earpiece shell 36, thus limiting space for other important components and/or limiting the sizes of earpiece shells that can be used with the transducer 41. Also, the size of the mounting plate 42 is necessarily a function of the size of the fasteners used to fasten the mounting plate 42 to the earpiece shell 38, which limits how small the mounting plate 42 can be in the earpiece 44 because a minimal size is necessary to accommodate such fasteners. Also, removal and replacement of the transducer 41 is tedious because of difficulties in accessing the screw 46 through a small opening 47 in the earpiece shell 36.

FIGS. 1, 2, and 4-6 show an embodiment of the improved hearing aid apparatus 10 that does not suffer from the drawbacks associated with the earpiece 44 shown in FIG. 3. The transducer 26 is preferably located partially or completely within the cavity 38 and attached adjacent the inner surface 40 of the earpiece shell 36. The transducer 26 further includes the spring member 18 attached adjacent the housing 28, a weight 48 attached adjacent the spring member 18, and the means for initiating vibration 16 disposed at least partially within the housing 28. The earpiece 30 also preferably includes a cover plate 50 for covering an aperture 52 defined by the entrance to the cavity 38 of the earpiece shell 36. The earpiece shell 36 is preferably made of one or more acrylate polymers or copolymers. Preferably, the transducer 26 is removably attachable adjacent the inner surface 40 of the earpiece shell 36 so that the same transducer 26 may be used with different earpiece shells. The housing 28 is the portion of the transducer 26 that is attached adjacent the inner surface 40 of the earpiece shell 36, and such housing 28 is preferably press fit into position within the cavity 38 without using fasteners or other objects that unnecessarily take up space within the cavity 38 and require tedious assembly procedures.

Figure 5:
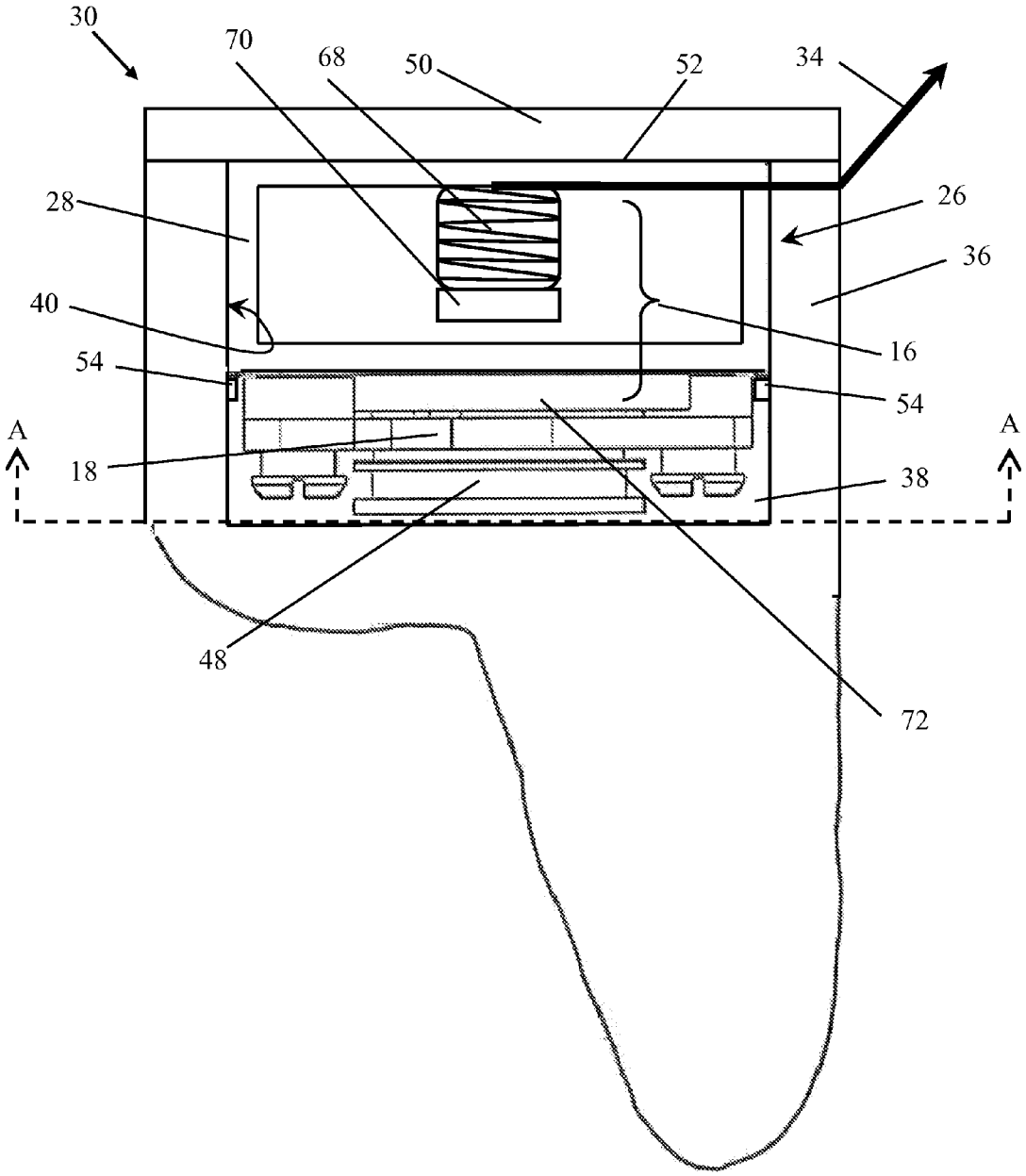
FIG. 5 shows a somewhat schematic cross-sectional view of an embodiment of an ITE hearing aid apparatus.
Figure 6:
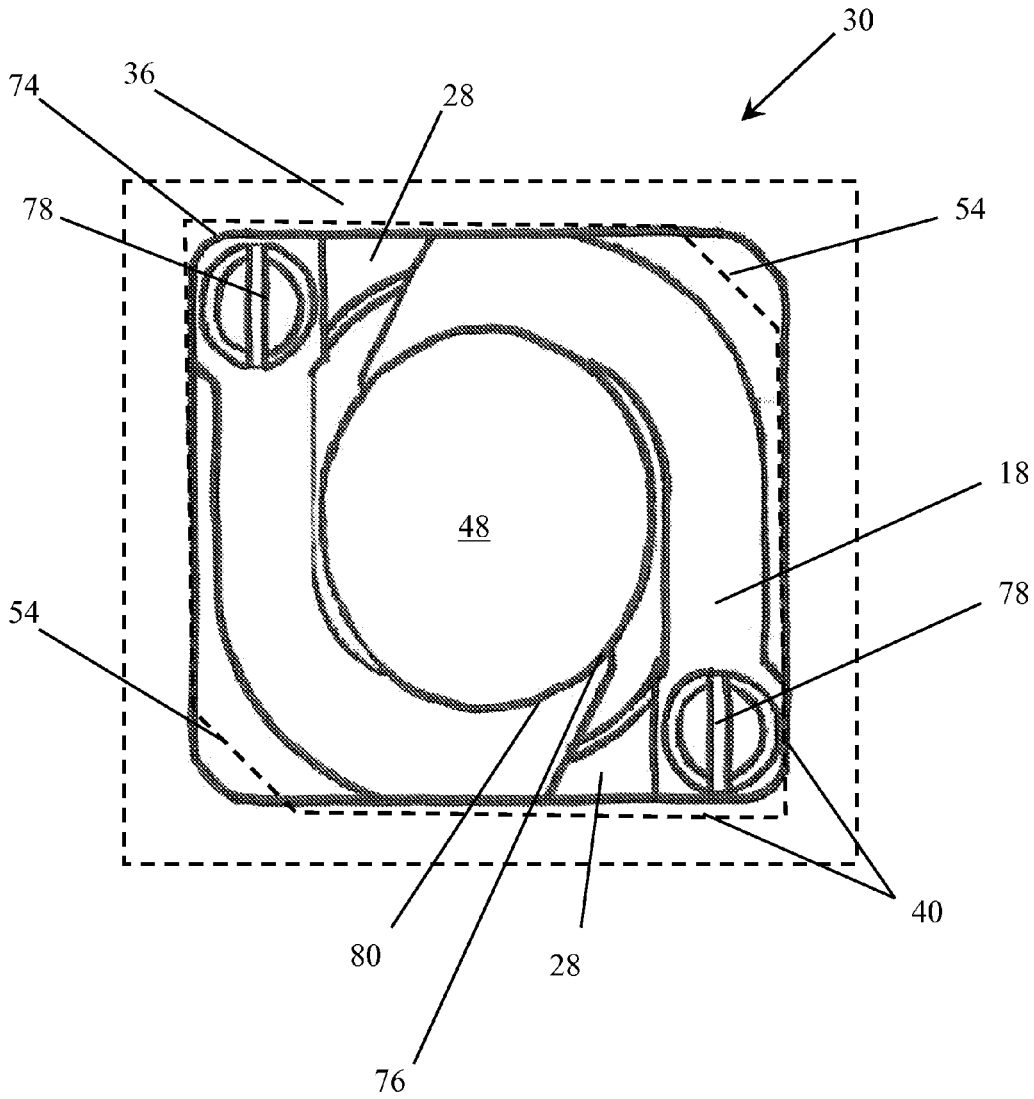
FIG. 6 shows a somewhat schematic cross-sectional view taken along line A-A of FIG. 5.
Figure 7A:
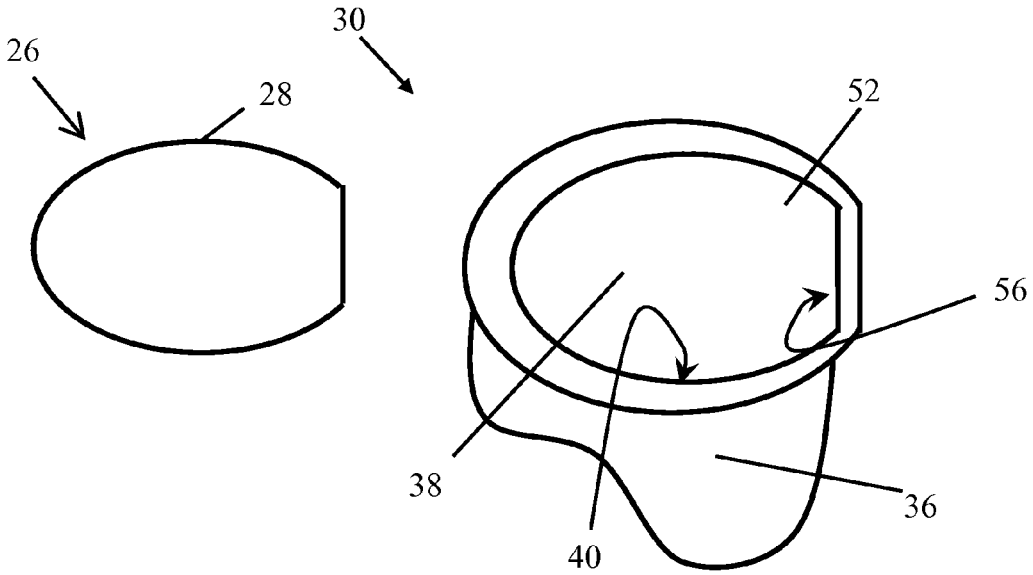
FIG. 7A shows a somewhat schematic view looking down onto an embodiment of a transducer and a corresponding earpiece configured for receiving the transducer.
Figure 7B:
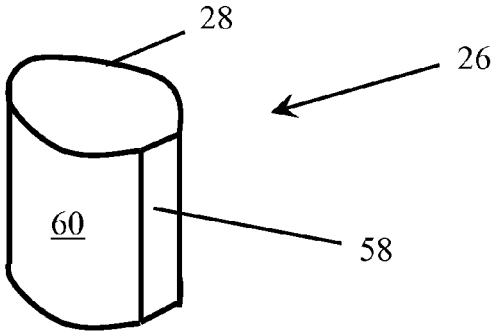
FIG. 7B shows a somewhat schematic perspective view of the transducer shown in FIG. 7A.
Figure 8A:
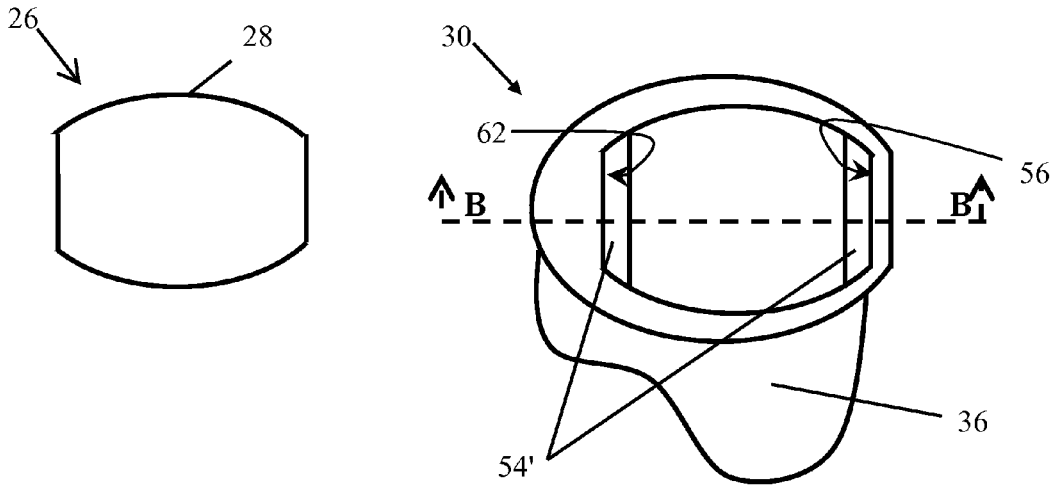
FIG. 8A shows a somewhat schematic view looking down onto an embodiment of a transducer and a corresponding earpiece configured for receiving the transducer.
Figure 8B:
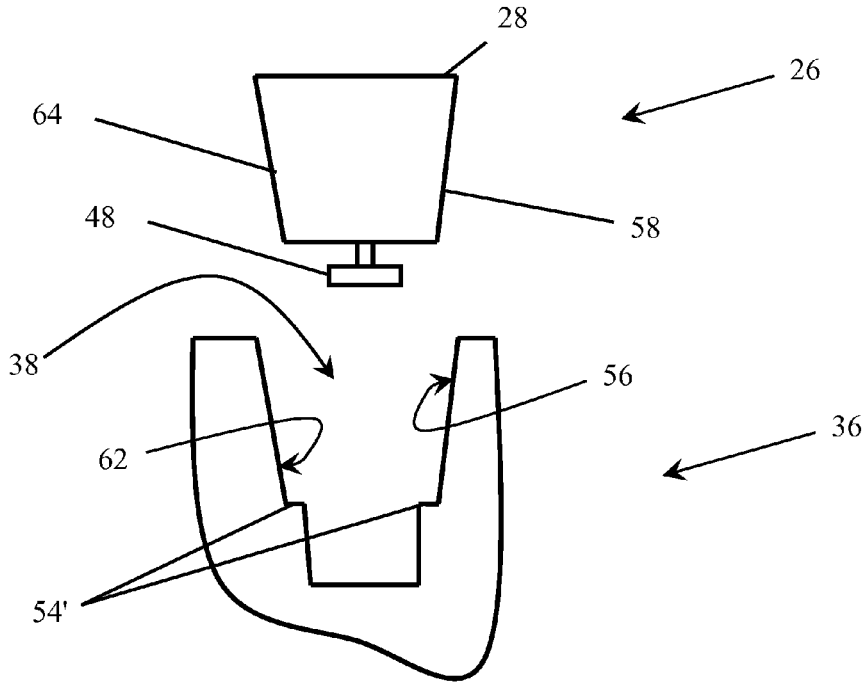
FIG. 8B shows a somewhat schematic cross-sectional view taken along line B-B as shown in FIG. 8A.

In the embodiment shown in FIGS. 5 and 6, one or more interference members 54 (e.g., a ledge or other interrupting feature formed along the inner surface 40 of the earpiece 30) limit the depth to which the housing 28 may be pressed into the cavity 38. In one embodiment shown in FIGS. 7A and 7B, the inner surface 40 of the earpiece shell 36 includes a substantially planar first subsurface 56 for engagement adjacent a first portion 58 of an outer surface 60 of the housing 28. In a related embodiment shown in FIGS. 8A and 8B, the inner surface 40 of the earpiece shell 36 includes a substantially planar second subsurface 62 for engagement adjacent a second portion 64 of the outer surface of the housing 28. Also, these respective surfaces may be angled as shown most clearly in FIG. 8B to facilitate press fitting of the transducer 26 within the earpiece shell 30. Interference members 54' are also shown in FIGS. 8A and 8B. In other contemplated embodiments, for example, only the first subsurface 56 and the first portion 58 of the outer surface of the housing 28 could be angled to achieve the same wedging effect when a transducer is press fit into an earpiece shell. In embodiments with one or more pairs of engageable angled surfaces, one or more interference members 54 would not be necessary because of the created wedging effect. Nonetheless, one or more interference members 54 can be used to better ensure that a transducer is not forced into an earpiece beyond a desired maximum depth.

The earpiece shell 36 is preferably made of a vibrationally conductive material suitable for transferring vibration produced by the transducer 26 into the ear canal of a user and then to the user's mastoid bone. Suitable materials include hard plastic, hard Lucite and acrylic materials. In many such earpieces, the means for initiating vibration 16 of the transducer 26 preferably includes a coil 68, a magnet 70, and a magnetic plate 72 as shown in FIG. 5. In other embodiments, the means for initiating vibration comprises another type of electromagnetic transducer, a piezoelectric crystal transducer, a differential floating mass transducer, or other similar devices. Accordingly, one skilled in the art will appreciate that the invention is not limited to any particular device or structure for initiating vibration based on an electrical signal.

An example shown in FIG. 6 illustrates the spring member 18, preferably a two-section linear spring, wherein each section includes a first end 74 and a second end 76. The first end 74 of each section of the spring member 18 is attached to the housing 28 using a screw 78, and the second end 76 of each section is attached to the weight 48 adjacent a second location 80. Unlike the embodiments shown in FIGS. 3 and 4, the weight 48 shown in FIGS. 1, 2, and 4-6 is free to move on the spring sections within the cavity 38 without touching the earpiece shell 36. Also, the weight 48 can be much smaller than the mounting plate 42 used in the embodiments shown in FIGS. 3 and 4 because there is no need to provide room for attaching fasteners to the weight 48 in the embodiment shown in FIGS. 1, 2, and 4-6. The weight 48 has a known first mass $M_1$ such that the peak vibration frequency of the earpiece can be predicted or otherwise maintained within a specified range. The weight 48 may be constructed from any material or combination of materials that provide the desired mass.

The weight 48 and spring member 18 preferably may be removed by removing the screws 78. In this manner, a second weight having a known second mass $M_2$ can be interchanged with the original weight, thereby providing the capability of altering the peak frequency of the earpiece 30 by substituting the original weight 48 having mass $M_1$ with a second weight having mass $M_2$, wherein $M_1$ does not equal $M_2$. Additionally or alternatively, the entire transducer 26 including the original weight 48 could be substituted with a second transducer including a second weight having mass $M_2$, thereby accomplishing the same alteration in output peak frequency during use. This interchangeability provides one or more methods for altering the output frequency of a hearing aid apparatus including, for example, the steps of (i) removing a first object from an earpiece (e.g., the earpiece 30 shown in FIG. 5) wherein the first object at least includes the original (or first) weight 48 having mass $M_1$; and (ii) adding a second object to the earpiece to replace the first object, wherein the second object at least includes the second weight having mass $M_2$. In a related embodiment, the first object could include the first transducer 26 and first weight and the second object could include a second transducer and the second weight having mass $M_2$.

The hearing aid apparatus 10 operates based on the steps of receiving input information in the form of sound waves or other signals (e.g., direct electrical signals), transforming the input information into transfer information (e.g., amplifying, filtering, or otherwise changing the input information), generating vibrational energy based on the transfer information, and conducting the vibrational energy through the housing 28, and through the earpiece shell 36 to a user's skull for interpretation by a user's brain. Unlike the prior art structure shown in FIGS. 3 and 4, vibrational energy is not transferred through the spring member 18 to the mounting plate 42 (and associated fastener(s)) and then through the earpiece shell 36. Rather, in the embodiments shown in FIGS. 1, 2, and 4-6, vibrational energy is transferred directly through the housing 28 to the earpiece shell 36, while the frequency remains a function of the mass of the weight 48 attached adjacent the spring member 18.

The previously described embodiments of the present disclosure have many advantages, including increasing the number, types, and sizes of earpiece shells that can be used for ITE and other hearing aid applications. The embodiments described above also eliminate the need to attach a mounting plate to an earpiece shell, which, due to size constraints, can easily become dislodged or otherwise separated from an earpiece shell, thereby rendering prior art versions of such hearing aids virtually useless. Additionally, the weight used in various embodiments described above can have a mass much less than the prior art mounting plates, and less mass translates into higher peak frequency output by the disclosed embodiments. Higher peak frequency output is preferable to lower peak frequency, so this feature is an additional benefit to the disclosed embodiments.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

Any element in a claim that does not explicitly state "means for" performing a specified function, or "step for" performing a specific function, is not to be interpreted as a "means" or "step" clause as specified in 35 U.S.C. §112, ¶6. In particular, the use of "step of" in the claims herein is not intended to invoke the provisions of 35 U.S.C. §112, ¶6.

What is claimed is:

1. An apparatus for imparting vibrational energy to a user for assistance in hearing, the apparatus comprising:

an earpiece shell having a cavity that defines an inner surface of the earpiece shell, the cavity having a first portion and a second portion adjacent the first portion, the earpiece shell having an outer surface configured for contacting an ear canal of the user; and a transducer disposed at least partially within the cavity of the earpiece shell, the transducer comprising:

a housing engaged with the inner surface of the earpiece shell and disposed within the first portion of the cavity;

at least one first spring member disposed within the second portion of the cavity, the at least one first spring member having first and second ends, the first end secured to the housing;

a first weight disposed within the second portion of the cavity, the first weight attached to the second end of the at least one first spring member and operable to vibrate within the second portion of the cavity without contacting the inner surface the earpiece shell; and means disposed at least partially within the housing for causing the first weight to vibrate, the earpiece shell for conducting the vibrational energy generated by the first weight through the outer surface of the earpiece shell and to the ear canal of the user.

2. The apparatus of claim 1 wherein the housing of the transducer engages the inner surface of the first portion of the cavity in a press fit configuration.

3. The apparatus of claim 1 wherein the inner surface of the cavity of the earpiece shell includes an interference structure which controls a depth of insertion of the housing when the housing is inserted into the first portion of the cavity, such that the housing is precluded from occupying the second portion of the cavity.

4. The apparatus of claim 1 wherein the earpiece shell is formed from one or more acrylate polymers.

5. The apparatus of claim 1 further comprising:

the earpiece shell including an aperture through which the housing of the transducer is inserted into the first portion of the cavity; and a cover plate configured for substantially covering the aperture and enclosing the housing within the first portion of the cavity.

6. The apparatus of claim 1 wherein the inner surface of the earpiece shell within the first portion of the cavity further comprises at least two substantially flat inner sub-surfaces including a first inner sub-surface and a second inner sub-surface, and wherein the housing of the transducer further comprises an outer surface including at least two substantially flat outer sub-surfaces including a first outer sub-surface and a second outer sub-surface, wherein the first inner sub-surface fits tightly against the first outer sub-surface and the second inner sub-surface fits tightly against the second outer sub-surface.

7. The apparatus of claim 1 wherein the means for causing the first weight to vibrate further comprise a device selected from the group consisting of an electromagnetic transducer, a coil and magnet transducer, a piezoelectric crystal transducer, and a differential floating mass transducer.

8. The apparatus of claim 1 further comprising one or more removable fasteners that secure the at least one first spring member to the housing, whereby the at least one first spring member and the first weight attached thereto may be detached from the housing by removing the one or more removable fasteners and replaced with at least one second spring member having a second weight attached thereto, wherein the second weight has a mass different from a mass of the first weight.

9. The apparatus of claim 1 wherein the means for causing the first weight to vibrate comprise:

a coil and magnet secured to the housing that remain stationary with respect to the housing during operation of the apparatus; and a magnetic plate attached to the first weight, the magnetic plate operable to move with respect to the coil and magnet to cause the first weight to vibrate.

10. An apparatus for imparting vibrational energy to a user for assistance in hearing, the apparatus comprising:

an earpiece shell having:

a cavity that defines an inner surface of the earpiece shell, the cavity having a first portion and a second portion adjacent the first portion, the inner surface of the cavity including an interference structure disposed within the cavity between the first portion and the second portion;

an aperture into the first portion of the cavity; and an outer surface configured for contacting an ear canal of the user;

a transducer disposed at least partially within the cavity of the earpiece shell, the transducer comprising:

a housing dimensioned to be inserted through the aperture of the earpiece shell and into the first portion of the cavity, the housing engaged with the interference structure of the earpiece shell which controls a depth of insertion of the housing into the cavity and precludes the housing from occupying the second portion of the cavity;

at least one spring member disposed within the second portion of the cavity, the at least one spring member having first and second ends, the first end secured to the housing;

a weight disposed within the second portion of the cavity, the weight attached to the second end of the at least one spring member and operable to vibrate within the second portion of the cavity without contacting the inner surface the earpiece shell; and means disposed at least partially within the housing for causing the weight to vibrate; and a cover plate configured for substantially covering the aperture in the earpiece shell and enclosing the housing of the transducer within the first portion of the cavity.

11. An apparatus for imparting vibrational energy to a user for assistance in hearing, the apparatus comprising:

an earpiece shell having a cavity that includes a first portion and a second portion that define an inner surface of the earpiece shell, the earpiece shell having an outer surface configured for contacting an ear canal of the user; and a transducer disposed at least partially within the cavity of the earpiece shell, the transducer comprising:

a housing engaged with the inner surface of the earpiece shell and disposed within the first portion of the cavity;

at least one first spring member disposed within the second portion of the cavity, the at least one first spring member having first and second ends, the first end secured to the housing;

a first weight having a first mass disposed within the second portion of the cavity, the first weight attached to the second end of the at least one first spring member and operable to vibrate within the second portion of the cavity without contacting the inner surface the earpiece shell;

one or more removable fasteners that secure the at least one first spring member to the housing;

at least one second spring member operable to be disposed within the second portion of the cavity, the at least one second spring member having first and second ends, the first end operable to be secured to the housing by the one or more removable fasteners; and a second weight having a second mass that is different from the first mass, the second weight operable to be disposed within the second portion of the cavity, the second weight attached to the second end of the at least one second spring member and operable to vibrate within the second portion of the cavity without contacting the inner surface the earpiece shell, wherein the at least one first spring member and the first weight attached thereto may be detached from the housing by removing the one or more removable fasteners, and the at least one second spring member and the second weight attached thereto may be attached to the housing the one or more removable fasteners; and means disposed at least partially within the housing for causing the first weight or second weight to vibrate, the earpiece shell for conducting vibrational energy generated by the first weight or second weight through the outer surface of the earpiece shell and to the ear canal of the user.

* * * * *